United States Patent [19]

Holland

[11] 4,077,288

[45] Mar. 7, 1978

[54] VERTICAL ENTRY MULTIPLE PAPER PUNCH

[75] Inventor: Donald L. Holland, Statesville, N.C.

[73] Assignee: Hunt Manufacturing Co., Philadelphia, Pa.

[21] Appl. No.: 757,519

[22] Filed: Jan. 7, 1977

[51] Int. Cl.[2] ..... B26F 1/02

[52] U.S. Cl. ..... 83/146; 83/687

[58] Field of Search ..... 83/146, 687

[56] References Cited

U.S. PATENT DOCUMENTS

| | | | |
|---|---|---|---|
| 2,368,790 | 2/1945 | Unger | 83/146 |
| 2,621,738 | 12/1952 | Pessina | 83/467 |
| 3,273,438 | 9/1966 | Brook | 83/687 X |
| 3,921,487 | 11/1975 | Otsuka et al. | 83/467 R |

*Primary Examiner*—Willie G. Abercrombie

*Attorney, Agent, or Firm*—Smith, Harding, Earley & Follmer

[57] ABSTRACT

A multiple paper punch has a base. A substantially vertical stripper plate is mounted on the base and has a plurality of openings for punch pins. A punch pin is mounted in each opening with each punch pin having a cam follower head. A substantially vertical die plate is mounted on the base adjacent the stripper plate and has openings in line with the openings in the stripper plate. The stripper plate and the die plate form a guide for the vertical entry of a sheet to be punched. An operating bar is mounted on a substantially horizontal pivot and has a depending cam portion adapted to engage the head of each punch pin. The punch pins and operating bar are biased to the inactive position by resilient means.

4 Claims, 3 Drawing Figures

VERTICAL ENTRY MULTIPLE PAPER PUNCH

BACKGROUND OF THE INVENTION

Multiple paper punches for punching holes in sheet material are well known to the art. Such a machine employing an operating bar having a cam portion to actuate multiple punches is shown in Neilsen U.S. Pat. No. 3,387,526. As in the case of Neilsen, the heretofore known paper punches have utilized vertically oriented punches to punch a sheet of paper presented in a substantially horizontal plane. Hopp U.S. Pat. No. 2,909,221 discloses moving a vertically oriented invoice against horizontally disposed punches. Hedderich U.S. Pat. No. 3,380,652 discloses a machine for encoding cards in a vertical disposition having a longitudinally moving cutter bar for severing a portion of the card when selected by a key and after the actuation of a rotatable handle.

The present invention has the convenience and ease of the vertical entry of a sheet to be punched which makes it far simpler to insert the sheet properly since the receiving opening is in clear view of the user without the inconvenience of stooping. In contrast to the above-discussed structure for punching invoices or cutting cards, the structure of the present invention is inexpensive and operates in a very simple yet effective manner. Gravity insures the proper alignment of the sheet as contrasted to a horizontal entry punch.

SUMMARY OF THE INVENTION

A multiple paper punch has a base. A substantially vertical stripper plate is mounted on the base and has a plurality of openings for punch pins. A punch pin is mounted in each opening with each punch pin having a cam follower head. A substantially vertical die plate is mounted on the base adjacent the stripper plate and has openings in line with the openings in the stripper plate. The stripper plate and the die plate form a guide for the vertical entry of a sheet to be punched. An operating bar is mounted on a substantially horizontal pivot and has a depending cam portion adapted to engage the head of each punch pin. The punch pins and operating bar are biased to the inactive position by resilient means.

DESCRIPTION OF THE PREFERRED EMBODIMENT

Figure 1:
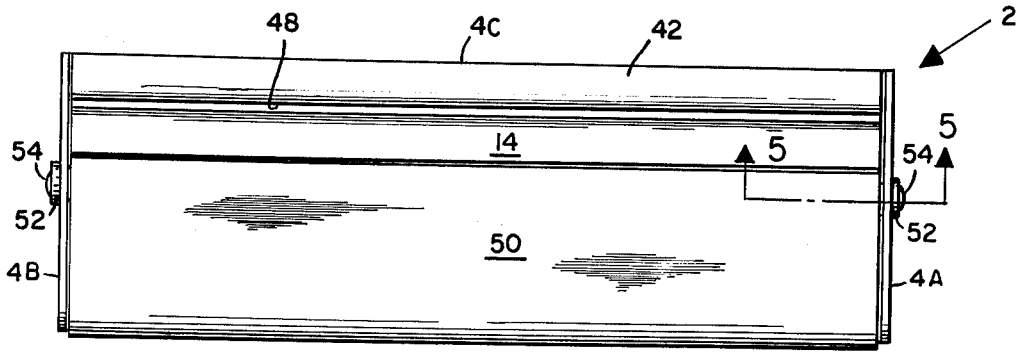
FIG. 1 is a plan view of a multiple paper punch in accordance with the invention.
Figure 2:
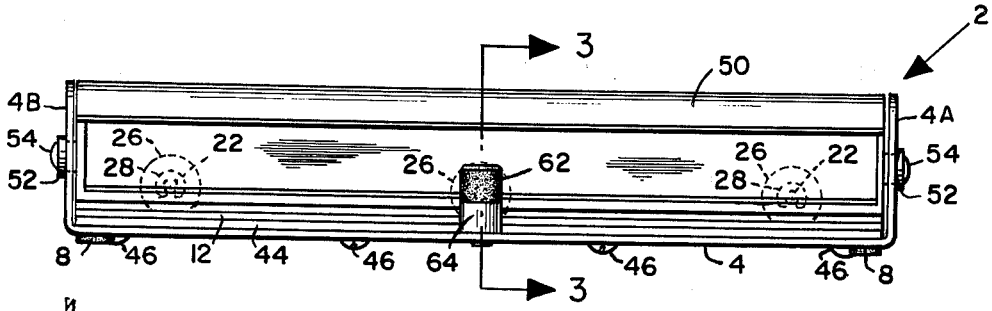
FIG. 2 is a rear elevation of the punch of FIG. 1.
Figure 3:
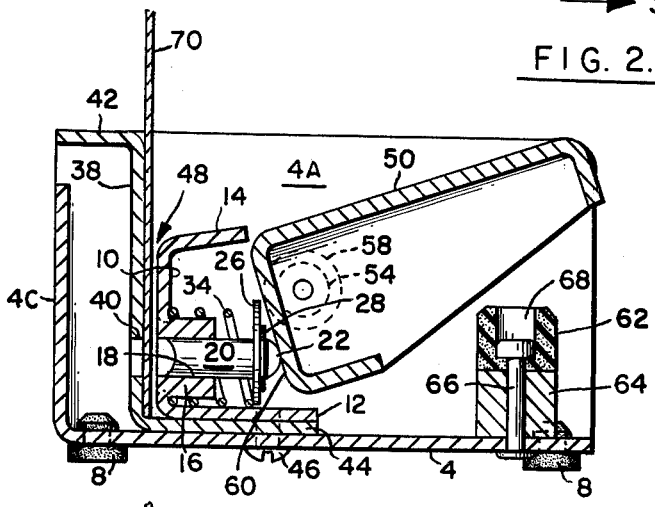
FIG. 3 is a vertical section taken on the plane indicated by the line 3—3 in FIG. 2 showing the punch parts in the inactive position with a sheet of paper inserted and ready for punching.

A multiple paper punch 2 has a base 4 (FIG. 2) with upstanding side panels 4A and 4B and an upstanding rear panel 4C (FIG. 3). Base 4 is mounted on rubber feet 8.

Figure 5:
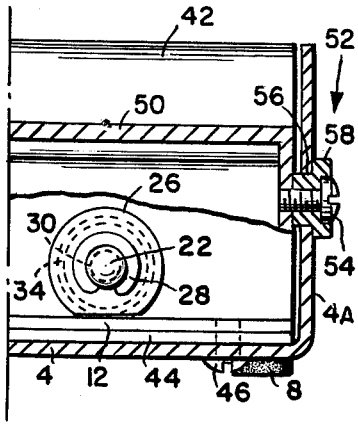
FIG. 5 is a vertical section, partially broken away, taken on the plane indicated by the line 5—5 in FIG. 1.

An upstanding stripper plate 10 has a bottom flange 12 and a top flange 14 which slopes slightly upwardly as it moves forwardly away from plate 10. Integral with plate 10 are three spaced substantially horizontal bosses 16 each having a substantially horizontal opening 18 therethrough containing a punch pin 20. Each punch pin 20 has a dome-shaped cam follower head 22 and carries a washer 26 abutting against a split ring 28 secured in groove 30 in pin 20 (FIG. 5). A compression coil spring 34 is mounted over each boss 16 and extends between the stripper plate 10 and the associated washer 26 to bias the pins 20 to the right as viewed in FIG. 3.

A substantially vertical die plate 38 has an opening 40 in line with each opening 18. Die plate 38 has an upper rearwardly directed flange 42 and a lower flange 44 which underlies flange 12 of stripper plate 10. Flanges 12 and 44 are secured to base 4 by screws 46. Die plate 38 and stripper plate 10 form a substantially vertical guide opening 48 for the vertical entry of a sheet to be punched.

An operating bar 50 is secured at opposite ends to a bearing member 52 by a screw 54 (FIG. 5). The bearing members are mounted respectively in side panels 4A and 4B of base 4 each in an opening 56. Each bearing member 52 has a headed portion 58 overlying its respective side panel of base 4. Bar 50 has a depending cam portion 60 engaging heads 22 of punch pins 20.

Figure 4:
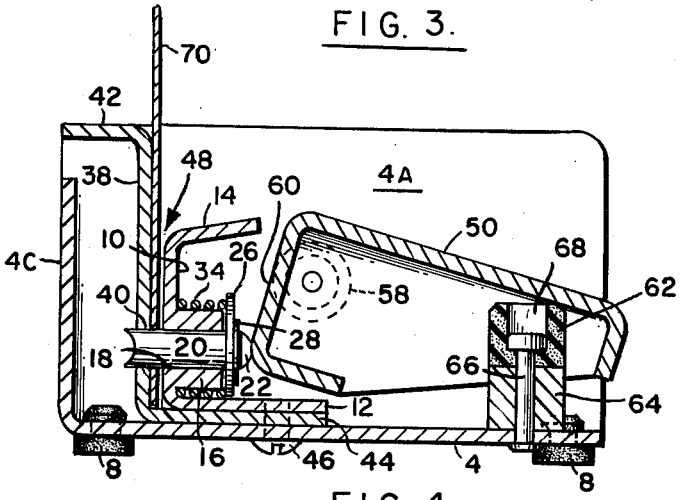
FIG. 4 is a vertical section taken on the plane indicated by the line 3—3 in FIG. 2 and showing the parts after the punch pins have passed through a sheet of paper.

As best seen in FIG. 4, a resilient grommet 62 of, for example, rubber, is coaxial with a metal grommet 64, both grommets being secured to base 4 by a rivet 66 which is recessed in opening 68 in grommet 62. The resilient grommet 62 limits the downward travel of operating bar 50 during the punching operation.

OPERATION

A sheet 70 is readily entered into punch 2 vertically by virtue of the fact that die plate 38 is substantially higher than stripper plate 10. This fact combined with the sloping flange 14 makes it very simple to guide sheet 70 between stripper plate 10 and die plate 38. Gravity causes the sheet to be properly seated on the bottom flange 44 of stripper plate 38. Once the paper 70 is seated, operating bar 50 is depressed causing it to rotate bearings 52 in openings 56 which results in moving depending cam portion 60 towards head 22 of each punch pin 20 which advances each pin 20 through its opening 18 through sheet 70 and through the corresponding opening 40 in die plate 38 to provide the desired openings in sheet 70. On releasing bar 50, springs 34 acting against washers 26 return pins 20 and operating bar 50 to their original positions.

The above described embodiment is intended to be illustrative and not limiting.

I claim:

1. A multiple paper punch comprising:

a substantially horizontal base, a substantially vertical stripper plate mounted on the base and having a plurality of substantially horizontal openings for punch pins, a substantially horizontal punch pin mounted in each opening, each punch pin having a cam follower head, a substantially vertical die plate mounted on the base behind the stripper plate with openings in line with the openings in the stripper plate, said stripper plate and said die plate forming a guide for the vertical entry of a sheet of paper to be punched, a downwardly actuated operating bar mounted on a substantially horizontal pivot which is in front of the stripper plate and having an integral depending cam portion adapted to engage said follower head of each punch pin, and spring means to bias the punch pins and operating bar to an inactive position.

2. A punch in accordance with claim 1 in which the die plate is higher than the stripper plate and the stripper plate has a flange to facilitate the vertical entry of a sheet between the die plate and the stripper plate.

3. A punch in accordance with claim 1 having a resilient member to limit the rotation of the operating bar during the punching operation.

4. A punch in accordance with claim 2 in which the stripper plate flange slopes upwardly as it extends away from the stripper plate.

* * * * *